US005084079A

United States Patent [19]

Frohnert et al.

[11] Patent Number: 5,084,079

[45] Date of Patent: Jan. 28, 1992

[54] HIGH-PRESSURE HOT SEPARATOR

[75] Inventors: Heinz Frohnert, Bottrop; Klaus Niemann, Oberhausen/Sterkrade; Werner Riedel, Bochum; Edgar Muschelknautz, Stuttgart, all of Fed. Rep. of Germany

[73] Assignee: Veba Oel Technologie GmbH, Gelsenkirchen, Fed. Rep. of Germany

[21] Appl. No.: 665,089

[22] Filed: Mar. 6, 1991

[30] Foreign Application Priority Data

Mar. 9, 1990 [DE] Fed. Rep. of Germany ..... 4007543

[51] Int. Cl.[5] ..... B01D 47/00

[52] U.S. Cl. ..... 55/238; 55/269; 55/274

[58] Field of Search ..... 55/238, 268, 269, 274, 55/337

[56] References Cited

FOREIGN PATENT DOCUMENTS 933826 9/1955 Fed. Rep. of Germany .

2646605 4/1978 Fed. Rep. of Germany .

3405730 8/1984 Fed. Rep. of Germany .

*Primary Examiner*—Bernard Nozick

*Attorney, Agent, or Firm*—Oblon, Spivak, McClelland, Maier & Neustadt

[57] ABSTRACT

A high-pressure hot separator for the separation of an overhead product from a process of high-pressure hydrogenation of coals, tars, crude oils, whose distillation and extraction products or similar carbon-containing feedstock such as heavy oils, low-temperature carbonization oils, extracts of heavy oil sands and the like, is downstream from the bottom phase reactors of the high-pressure hydrogenation. The separator is constructed from a vertically erected cylindrical pressure jacket having an upper cover, a lower cover, an inside adjacent thermal insulation member and a cylindrical wall insert. The overhead product is separated into a gas/vapor phase and a bottom product. A cyclone separator is installed in the gas/vapor space of the hot separator for improvement of the separation function.

10 Claims, 2 Drawing Sheets

HIGH-PRESSURE HOT SEPARATOR

BACKGROUND OF THE INVENTION

The present invention relates to a high-pressure hot separator for the separation of an overhead product from a process of high-pressure hydrogenation of coals, tars, crude oils, whose distillation and extraction products or similar carbon-containing feedstock such as heavy oils, low-temperature carbonization oils, extracts of heavy oil sands and the like, which is downstream from the bottom phase reactors of the high-pressure hydrogenation. The overhead product is separated into a gas/vapor phase and a bottom product. The separator is constructed from a vertically erected cylindrical pressure vessel jacket (11) with an upper cover (12) and a lower cover or bottom (13), an inside adjacent thermal insulation (14), a cylindrical wall insert (18), which changes into a lower tapering part (18*a*), with product intake pipe (1) in the pressure vessel, output connecting piece (3) for the gas/vapor phase from the pressure vessel, bottom discharge connecting piece (5) and a cooling circuit provided in wall insert (18), (18*a*) for indirect cooling.

Hot separators, as they are known for example in units for liquefying coal hydrogenation, consist of compression-proof vessels, which contain inserts cooled by pipe coils, to facilitate the separation of a liquid phase with liquid level in the lower vessel part and to prevent the less volatile stock, containing the separated even solid and ash components, from coking on the hot separator wall despite the high temperatures prevailing in the hot separator. The lower cooled insert is usually designed as a hopper by which the nonvolatile portions are removed. In practical operation it has been shown that despite the cooling of the lower insert by pipe coils, problems occur due to coking which causes the irregular running of the separator and even interruptions of operations (cf. "Die katalytische Druckhydrierung von Kohlen, Teeren and Mineraloelen [The Catalytic Pressure Hydrogenation of Coals, Tars and Crude Oils], Springer-Verlag, Berlin/Goettingen/Heidelberg, 1950, page 243 ff).

Usually hot separators are built for the initially mentioned use range, for which a pressure range up to about 1000 bars, preferably 150–500 bars, is suitable, in a finally geometrically and structurally fixed vessel form corresponding to the requirements for high and ultrahigh pressure standards.

With serious process-side mass flow changes, as they occur, for example, in the use of feedstocks other than grades of coal or heavy oils suitable for the high-pressure hydrogenation, for example, in the hydrogenation of extracts of heavy oil sands or tar sands, which are distinguished, i.e., by considerable contents of aluminum oxide from clays and which as ash-forming components pass into the overhead product of the bottom phase hydrogenation and thus into the hot separator, in a fixed vessel form, which because of the design for the ultrahigh pressures represent very expensive equipment, the degree of separation can considerably worsen. With such high-pressure vessels, geometric and structural changes to match the changed feedstocks and changed operating conditions and to optimize the degree of separation lead to additional costs.

From these circumstances the object of providing for a hot separator, which is determined in its geometry basically by the requirement, which follows from the use in the high-pressure and ultrahigh pressure range, of an optimizable separation function having a comparatively small expense follows.

An object of improving the separation capability of the known hot separator designs, also becomes evident by the fact that at least two hot separators, connected behind one another, have been used in a process for the production of liquid fuels by catalytic pressure hydrogenation in a bottom phase hydrogenation of heavy oils or oil residues and a directly coupled gas phase hydrogenation (cf. DE-PS 933 826).

These objects are achieved with the present invention, which consists in the fact that in the gas/vapor space of the hot separator there is installed a cyclone separator (4) with an connecting piece (2) for the tangential intake of a gas/vapor phase containing liquid components with solid content, a cylindrical section (4*a*) as well as a lower conical section (4*b*), a shielding cone (19) placed in the cylindrical or conical section in the area of the axis, a central pipe (4*c*) placed axially symmetrically for upward removal of the gas/vapor phase freed from the liquid parts, and central pipe (4*c*) reaches beyond the area of the intake connecting piece (2) downward into the cyclone separator and in the upward direction is connected to the output connecting piece of the gas/vapor phase from the high-pressure vessel.

A patent publication is known with respect to the related art, in which with the presence of several reactor stages it is indicated as suitable to provide at the head of each reactor an inside cyclone for retaining larger catalyst particles. The further separation of the catalyst particles is suitably to take place under process pressure by a cyclone, which is placed within the hot separator downstream from the hydrogenation reactor (cf. DE 26 46 605 C 2).

Further, DE 34 05 730 A 1 is known, in which a separator for flash evaporators of coal hydrogenation units as well as a process are described, in which the suspension from the pressure hydrogenation is expanded to slight pressures in one or more stages, before the suspension is fed to the separator. The separator exhibits a cyclone-like design.

A high-grade separation function in processes and feedstocks of the type as they are applied or used in the high-pressure hot separator according to the invention is not specified in the related art, but is essential because the bottom phase hydrogenation as a rule for recovery of products, which meet the reformer feedstock specifications, is immediately downstream from a so-called gas phase hydrogenation, after the residue phase to be separated in the hot separator is removed. An insufficient separation function would immediately become apparent in a pressure loss in the gas phase hydrogenation taking place in a fixed-bed catalyst, by the unseparated liquid particles entrained in the gas/vapor phase and solid residues and ash-forming components contained in the particles being precipitated on the fixed-bed catalyst and would block it.

Cyclone separator (4) installed in the interior of the hot separator according to the invention is a pure flow device and need not be designed for high pressure. Cyclone separator (4) can be calculated and be optimally designed according to existing process conditions and requirements.

A suitable configuration of the high-pressure hot separator consists in the intake connecting piece of the cyclone separator being provided with a scrubbing device consisting of a scrubber nozzle and feed pipe for scrubbing liquid. In this way, the formation of solid deposits in the area of the intake connecting piece of the cyclone separator can be effectively prevented.

The product intake pipe for the overhead product from the bottom phase reactor is suitably designed so that it ends in the gas/vapor space of the pressure vessel above the liquid level formed by the bottom product in the hot separator and is adapted to the form of the cylindrical wall insert so that basically a downward flow is directed tangentially obliquely against the wall insert.

It can be suitable to immerse the discharge of the bottom product from the cyclone separator by a discharge pipe under the liquid level in the hot separator. In the actual design, attention is to be given to the fact that a great partial vacuum may prevail in each cyclone in the axis. With great density in the high-pressure hot separator corresponding to the higher pressure the vacuum is much greater than is customary in normal uses. According to calculations, the cyclone would fill up from below. The shielding cone provided in the cylindrical part in the area of the axis serves to avoid this difficulty. By suitable dimensioning of the discharge pipe, it is possible to prevent the pipe from being stopped up by solid deposits.

For the above reasons another suitable embodiment provides that the bottom product is removed from the conical part of the cyclone separator by a pipe connected to a flash pot downstream from the hot separator.

But in the above-mentioned configuration the conical part of the cyclone separator can also be made closed downward. In this case, the main part of the condensed bottom product, as before, is removed by the bottom discharge connecting piece in the lower cover of the hot separator. Only the amount of liquid separated in cyclone separator (4) is removed from the high-pressure vessel by a separate pipe run, for example, through the output connecting piece for the gas/vapor phase.

The high-pressure hot separator for the above-mentioned reasons is suitably equipped with a level control measurement. The latter can be made as a differential pressure measurement, and hydrogen is bubbled through by two separate pipes, the so-called zero pipe and a pipe reaching into the bottom of the conical part of the cyclone and the differential pressure to be measured is registered on the basis of the height of the level in the hydrogen feed pipes.

The hydrogen intake pipes for the level measurement as well as pipe (20) for the removal of the bottom product from the conical part of the cyclone separator are run, e.g., from the high-pressure vessel through the special convex seal on the output connecting piece of the gas/vapor phase, as it is represented in detail in FIG. 4.

By direct introduction through the intake pipe (8) of hydrogen-containing gases into the liquid level of the bottom product in lower conical separator part (18*a*), a hydrogen depletion, which can lead to an additional coke formation and deposit, is counteracted.

Vertical cylindrical wall insert (18) of the high-pressure hot separator, according to a suitable configuration, by the conical part turns into bottom discharge connecting piece (5) in the bottom of the pressure vessel.

The cylindrical wall insert will be a component of a cooling circuit for indirect cooling by pipes, run through the upper or lower cover of the pressure vessel, for feeding and discharge of coolant, and the wall insert can be made of finned pipes as they are known in boiler technology. But the wall insert can also consist of ordinary pipes with flanges welded in between.

By the tangential flow with the overhead product of the bottom phase hydrogenation on the vessel wall a certain preseparation is achieved and the mode of operation of the hot separator as a gravity separator is improved in that the liquid level in the hot separator is not unnecessarily raised again by condensed liquid portions falling from a certain height.

The present high-pressure hot separator in cases of especially wear-intensive mineral components in the overhead product of the bottom phase hydrogenation, such as, e.g., aluminum oxide from clays, as they occur in the use of oils from tar sands on especially wear-stressed zones or on the entire inner surface can be equipped with a wear-armoring, for example made of tungsten carbide or wear-resistant ceramic coatings.

SUMMARY OF THE INVENTION

Accordingly, the present invention relates to a high-pressure hot separator for the separation of an overhead product from a high-pressure hydrogenation process of coals, tars, crude oils or the like. The distillation and extraction products or similar carbon-containing feedstock of the process being downstream from the bottom phase reactors of the high-pressure hydrogenation. The overhead product being separated into a gas/vapor phase and a bottom product. The high-pressure hot separator comprising a vertically erected cylindrical pressure vessel jacket having an upper cover and a lower cover; an inside adjacent thermal insulation member; a cylindrical wall insert having a lower tapering portion; a product intake pipe disposed in the pressure vessel; an output connecting piece for the gas/vapor phase from the pressure vessel; and a bottom discharge connecting piece and a cooling circuit provided in the tapered portion of the wall insert for indirect cooling.

The high-pressure hot separator further comprising a cyclone separator provided in a gas/vapor space of the hot separator. The cyclone separator comprising an intake pipe for the tangential intake of a gas/vapor phase containing solid content liquid components. The cyclone separator defining a cylindrical section and a lower conical section, wherein a shielding cone is positioned in at least one of the cylindrical section or conical section along the vertical axis of the cyclone separator. The cyclone separator further comprising a central pipe for upward removal of the gas/vapor phase which is freed from the liquid parts. The central pipe extending beyond the area of the intake connecting pipe in a downward direction into the cyclone separator. An upper part of the central pipe being connected to the output connecting piece of the gas/vapor phase from the high pressure vessel.

BRIEF DESCRIPTION OF THE DRAWINGS

A more complete appreciation of the invention and man of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
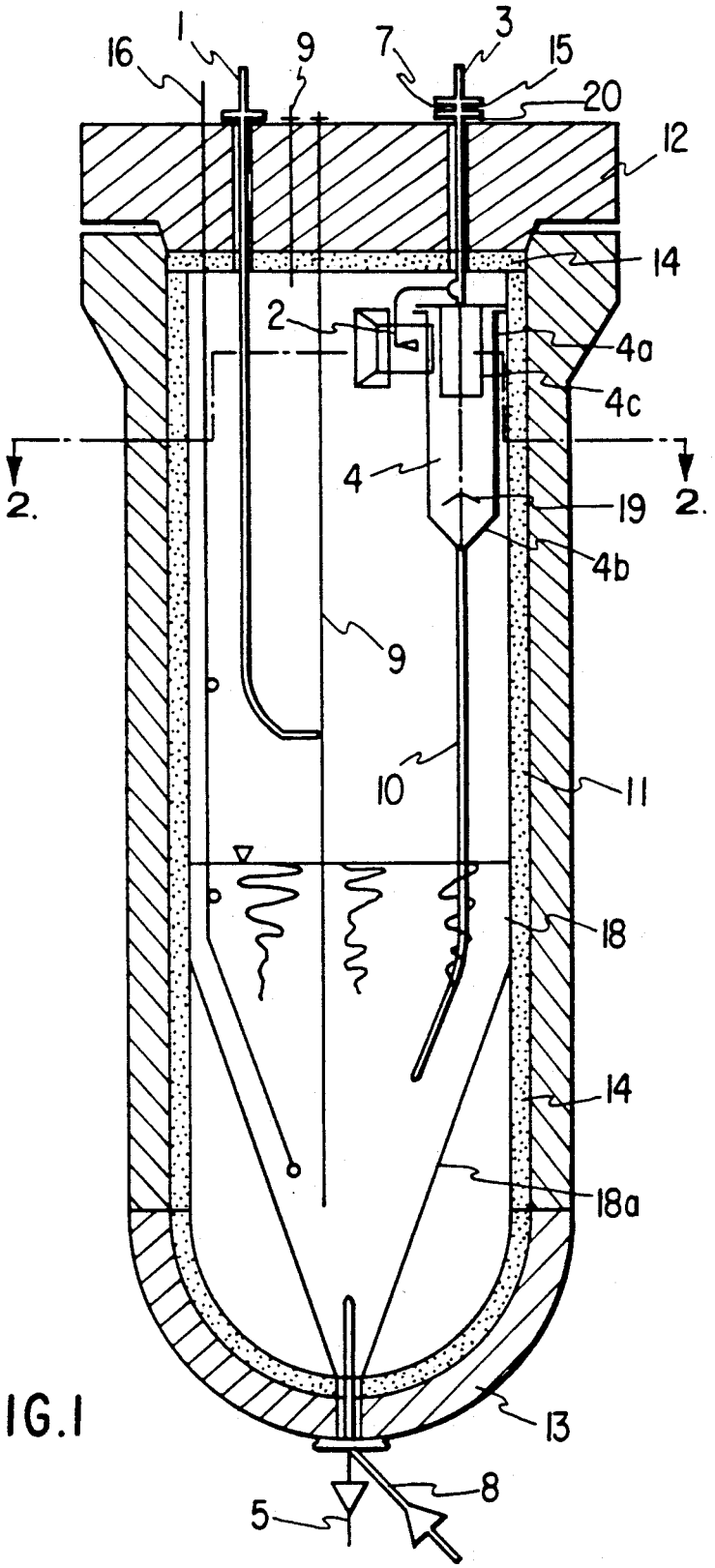
FIG. 1 shows an overall view of a high pressure hot separator with installed cyclone separator in a longitudinal section.
Figure 2:
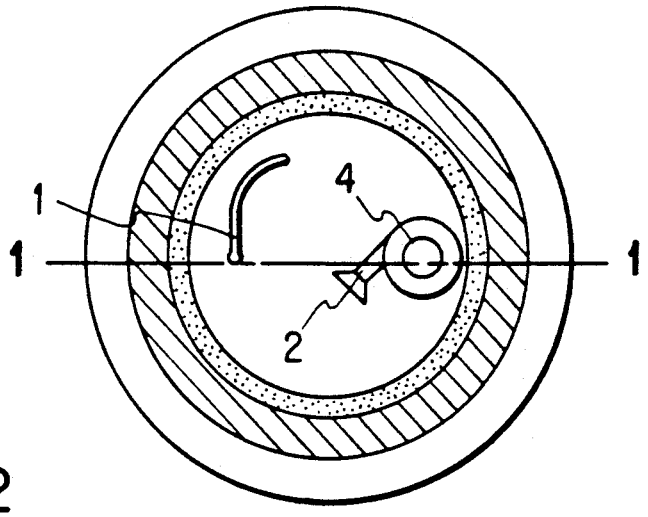
FIG. 2 represents a section along line A—A of FIG. 1.
Figure 3:
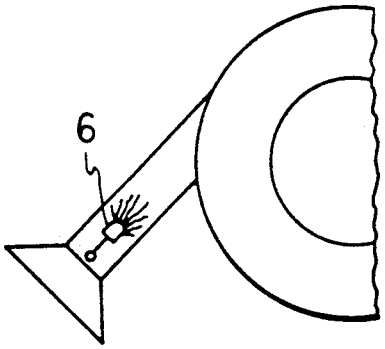
FIG. 3 shows in an enlarged representation a cross section through the cyclone separator, from which the position of the scrubber nozzle in an input connecting piece in the cyclone separator can be seen.

Referring now to FIGS. 1-4 of the drawings, wherein like reference numerals designate identical or corresponding parts throughout the several views, the high-pressure hot separator consists of a cylindrical vertically erected vessel jacket (11) with reinforced flange additional zones on the ends, with which upper cover (12) and lower cover (13) are firmly bolted. Thermal insulation (14) is provided within pressure vessel jacket (11) and covers (12) and (13). Non-supporting wall insert (18), which is tapered on the lower end, is adjacent to the thermal insulation of pressure vessel jacket (11). Tapered wall insert (18*a*) comes out on the lower end into bottom discharge connecting piece (5). The overhead product of the bottom phase hydrogenation from the bottom phase reactor enters the high-pressure vessel by product intake pipe (1) through the upper cover (12). The gas/vapor phase—under the prevailing pressure and temperature conditions in the high-pressure hot separator freed from entrained liquid components, which also contain enclosed residual or ash-forming components as well as liquid particles condensed in the high-pressure hot separator under the pressure and temperature conditions—leaves the high-pressure hot separator by output connecting piece (3) which also runs through the upper cover (12). The product intake pipe in the high-pressure vessel in the area of its mouth is designed so that also the overhead product containing liquid and residual components flows from the bottom phase reactor into pressure vessel jacket (11) directed tangentially and downward for a short distance above the liquid level maintained by the measuring and control devices. The measuring and control devices are provided with the necessary data by temperature measuring probe (16) as well as level measuring probe (9).

Cyclone separator (4) is fastened in the gas/vapor space of the high-pressure hot separator on upper cover (12) and centered on the output connecting piece (3) of the gas/vapor phase from the high-pressure vessel. Cyclone separator (4) consists of the usual components, namely an intake connecting piece (2), cylindrical part (4*a*), conical part (4*b*) as well as central pipe (4*c*), which is fastened on the upper end of cylindrical part (4*a*) and has a connection to output connecting piece (3). Central pipe (4*c*) in the cylindrical part of the cyclone is run downward so far that it projects with its mouth above the intake area of the intake connecting piece (2) in the cyclone separator (4), by which an entraining or a short-circuit mixing between the process stream still containing liquid components entering by intake connecting piece (2) and the "dried" process stream is avoided. Pipe (7) for a suitable scrubbing liquid to scrub intake connecting piece (2) free by scrubber nozzle (6) is run through output connecting piece (3). The discharge on lower conical part (4*b*) of cyclone separator (4) is made as in immersion pipe (10) immersed in the liquid level of the high-pressure vessel.

Figure 4:
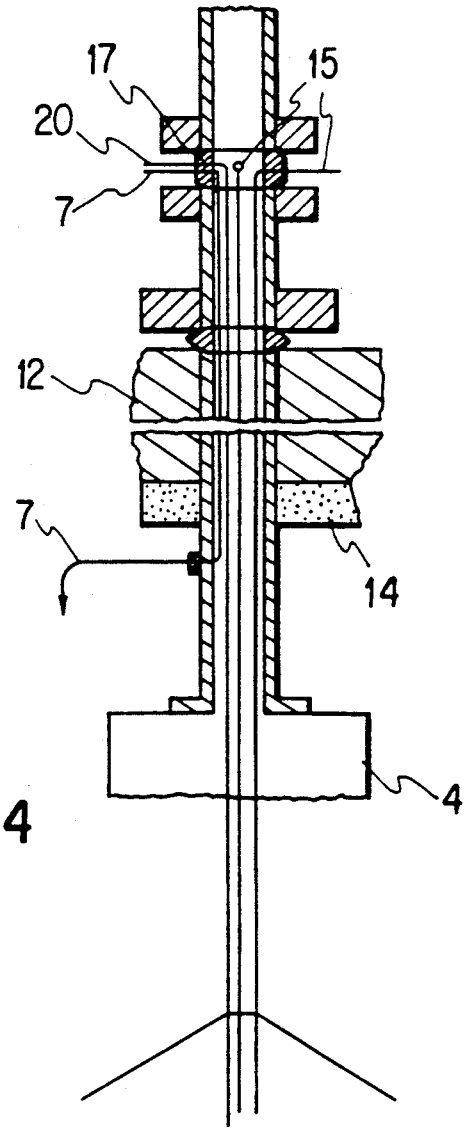
FIG. 4 is a view of the output connecting piece leading from the hot separator for the gas/vapor phase in longitudinal section and in greater detail.

Output connecting piece (3) and the measuring and product pipes run through it are represented in greater detail in FIG. 4. The reference symbols in FIG. 4 have the same meaning as in FIGS. 1 to 3. Additionally, in FIG. 4 special convex seal (17) is represented, through which feed pipe (7) as well as pipes (15) for the level measurements are run. Also a discharge pipe, not shown here, for the bottom product from the cyclone separator (4) can also be run through output connecting piece (3), if the cyclone separator (4) is designed closed on its lower conical end.

The hydrogen intake pipes for he level measurement as well as the pipe (20) for the removal of the bottom product from the conical part of the cyclone separator are run, e.g., from the high-pressure vessel through the special convex seal on the output connecting piece (3).

The axially symmetrically arranged installation of shielding cone (19) in the conical part of the cyclone immersion pipe (10) provides for shielding from the vacuum prevailing in the cyclone axis.

By direct introduction through the intake pipe (8) (FIG. 1) of hydrogen-containing gases into the liquid level of the bottom product int he lower conical separator (18*a*), hydrogen depletion is counteracted.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A high-pressure hot separator for the separation of an overhead product from a high-pressure hydrogenation process of coals, tars, crude oils or the like, whose distillation and extraction products or similar carbon-containing feedstock is downstream from bottom phase reactors of the high-pressure hydrogenation, the overhead product being separated into a gas/vapor phase and a bottom product, said high-pressure hot separator comprising:

a vertically erected cylindrical pressure vessel jacket having an upper cover and a lower cover;

an inside adjacent thermal insulation member;

a cylindrical wall insert having a lower tapering portion;

a product intake pipe disposed in said pressure vessel;

an output connecting piece for the gas/vapor phase from the pressure vessel;

a bottom discharge connecting piece and a cooling circuit provided in said tapered portion of said wall insert for indirect cooling; and a cyclone separator provided in a gas/vapor space of said hot separator, said cyclone separator comprising an intake pipe for the tangential intake of a gas/vapor phase containing solid content liquid components, said cyclone separator defining a cylindrical section and a lower conical section, wherein a shielding cone is positioned in at least one of said cylindrical section or conical section along the vertical axis of said cyclone separator, said cyclone separator further comprising a central pipe for upward removal of said gas/vapor phase which is freed from said liquid parts, said central pipe extending beyond the area of said intake connecting pipe in a downward direction into the cyclone separator, an upper part of said central pipe being connected to the output connecting piece of the gas/vapor phase from the high pressure vessel.

2. High-pressure hot separator according to claim 1, wherein said intake connecting piece of said cyclone separator is equipped with a scrubbing device comprising a scrubber nozzle and a feed pipe scrubbing liquid.

3. High-pressure hot separator according to claim 1, wherein said product intake pipe ends in the gas/vapor space of the pressure vessel above the liquid level formed by the bottom product so that a downward flow is directed tangentially obliquely against the wall insert.

4. High-pressure hot separator according to claim 1, wherein the discharge of the bottom product from the conical section of said cyclone separator is immersed by a discharge pipe under the liquid level in the hot separator.

5. High-pressure hot separator according to claim 1, wherein the bottom product can be removed from the conical section of the cyclone separator by a pipe connected to a flash pot downstream from the hot separator.

6. High-pressure hot separator according to claim wherein the conical section of said cyclone separator is closed at its lower end.

7. High-pressure hot separator according to claim 1, wherein said cyclone separator is equipped with a level control measurement means.

8. High-pressure hot separator according to claim 1, wherein a means for direct introduction of hydrogen-containing gases into the liquid level of the bottom product in the lower tapering portion of said wall insert is provided.

9. High-pressure hot separator according to claim 1, wherein said pressure vessel jacket is reinforced with an upper and lower flange means.

10. High-pressure hot separator according to claim I, wherein the lower tapering portion of said wall insert comes out in said bottom discharge connecting piece.

* * * * *